US007505709B2

(12) United States Patent
Kamimura

(10) Patent No.: US 7,505,709 B2
(45) Date of Patent: Mar. 17, 2009

(54) IMAGE FORMING APPARATUS, PROCESS UNIT, AND DEVELOPING CARTRIDGE

(75) Inventor: Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 274 days.

(21) Appl. No.: 11/466,931

(22) Filed: Aug. 24, 2006

(65) Prior Publication Data

US 2007/0048007 A1 Mar. 1, 2007

(30) Foreign Application Priority Data

Aug. 26, 2005 (JP) ..... 2005-246109

(51) Int. Cl.
*G03G 15/06* (2006.01)

(52) U.S. Cl. ..... 399/111; 399/113; 399/116; 399/222

(58) Field of Classification Search ..... 399/96, 399/110, 111, 113, 116, 159, 222, 257
See application file for complete search history.

(56) References Cited

U.S. PATENT DOCUMENTS 4,821,063 A 4/1989 Kaneshige
4,912,509 A 3/1990 Kaneshige
5,805,959 A 9/1998 Hazama et al.
5,815,644 A * 9/1998 Nishiuwatoko et al. ..... 399/113
5,845,176 A 12/1998 Yoshida et al.
6,041,203 A * 3/2000 Suzuki et al. ..... 399/111
6,115,569 A * 9/2000 Akutsu ..... 399/111
6,173,140 B1 * 1/2001 Suzuki et al. ..... 399/113
6,384,940 B1 * 5/2002 Kawai et al. ..... 358/474
6,871,031 B2 * 3/2005 Blaine et al. ..... 399/113
6,879,792 B2 * 4/2005 Carter et al. ..... 399/113
7,386,254 B2 * 6/2008 Okoshi ..... 399/113

FOREIGN PATENT DOCUMENTS

JP 62272283 11/1987
JP 5035002 2/1993
JP 8054786 2/1996
JP 9319285 12/1997

* cited by examiner

*Primary Examiner*—David M Gray
*Assistant Examiner*—G. M. Hyder
(74) *Attorney, Agent, or Firm*—Banner & Witcoff, Ltd

(57) ABSTRACT

When the drum axis of a photosensitive drum cartridge is engaged with an image forming apparatus, the developing roller axis of a developing cartridge is engaged with an engagement provided in the photosensitive drum cartridge. Then, after this, a positioning component of the developing cartridge engages with a developing cartridge engagement structure of the image forming apparatus, and the developing cartridge is thus positioned relative to the image forming apparatus. In addition, because an inhibiting device of the photosensitive drum cartridge and an inhibiting protrusion component of the developing cartridge are engaged, the photosensitive drum cartridge is positioned in the image forming apparatus via the developing cartridge. Because the developing cartridge may be positioned in the image forming apparatus without involving the photosensitive drum cartridge, the paper transport pathway space that is formed by the developing cartridge and the image forming apparatus is less likely to become disrupted.

25 Claims, 9 Drawing Sheets

IMAGE FORMING APPARATUS, PROCESS UNIT, AND DEVELOPING CARTRIDGE

RELATED APPLICATION INFORMATION

This application claims priority to Japanese Patent Application No. 2005-246109, filed Aug. 26, 2005, whose contents are expressly incorporated herein by reference.

BACKGROUND

1. Technical Field

The present invention relates to an electrostatic image forming apparatus and a process unit and a developing cartridge used for the image forming apparatus, e.g., in a copier, facsimile, laser printer, or other image forming apparatus.

2. Related Art

Conventionally, in image formation devices that supply developer to an electrostatic latent image formed on a photoreceptor and record the visible image showing the characters or images formed by transferring them onto a recording medium, processing units of the cartridge type are well known, in order to improve and simplify the maintenance characteristics and the changing operation.

With this sort of conventional image formation device, processing cartridges equipped with a developer receptacle and a processing roller that attaches to and detaches from the photoreceptor cartridge after mounting the photoreceptor cartridge in the body of the image-formation device are well known. Additionally, processing units having a processing cartridge mounted on the photoreceptor cartridge in advance are known in which the processing unit is configured so that it can be attached to and detached from the body of the image formation device.

However, with the conventional image formation devices described above, the system is configured so that the photoreceptor cartridge is positioned relative to the image formation device, and furthermore, the processing cartridge is positioned relative to the photoreceptor cartridge. In other words, the processing cartridge is positioned relative to the image formation device via the photoreceptor cartridge. An explanation shall be given regarding this using FIG. 9.

FIG. 9 is a drawing showing the state where a processing unit 4 composed of a processing cartridge 36 and a photoreceptor cartridge 35 is mounted in a conventional image formation device as described above. First, regarding the photoreceptor cartridge 35, by maintaining the drum axis 37*a* of this photoreceptor cartridge 35 at a specified location in the image formation device, and also, by joining the protrusion 305 of the photoreceptor cartridge 35 and the body side positioning component 300 that is located in the image formation device, the photoreceptor cartridge 35 is positioned relative to the image formation device. In addition, by maintaining the processing roller axis 40*a* of the processing cartridge 36 at a specified location in the photoreceptor cartridge 35, and also, by joining the operating component 315 of the processing cartridge 36 and the photoreceptor side positioning component 310 that is located in the photoreceptor cartridge 35, the processing cartridge 36 is positioned relative to the photoreceptor cartridge 35. In other words, as stated previously, the processing cartridge 36 is positioned relative to the image formation device via the photoreceptor cartridge 35.

For this reason, the amount of displacement of the processing cartridge relative to the image formation device is an amount derived by adding the amount of displacement of the photoreceptor cartridge relative to the image formation device and the amount of displacement of the processing cartridge relative to the photoreceptor cartridge. Therefore, the possibility has existed that the amount of displacement of the processing cartridge relative to the image formation device would increase, or in other words, that positioning precision of the processing cartridge relative to the image formation device would worsen.

Also, as the positioning precision of the processing cartridge relative to the image formation device worsens, the printing paper transport pathway space composed of the processing cartridge and body of the image formation device can become disrupted. When the transport pathway space becomes disrupted, printing paper is no longer transported smoothly, and errors are likely to occur such as the printing paper jamming while being transported.

SUMMARY

Aspects of the present invention address one or more issues described above, thereby providing improved paper handling and/or other benefits.

BRIEF DESCRIPTION OF THE DRAWINGS

Aspects of the invention will be described in more detail below with reference to various example structures and the following figures.

DETAILED DESCRIPTION

Figure 1:
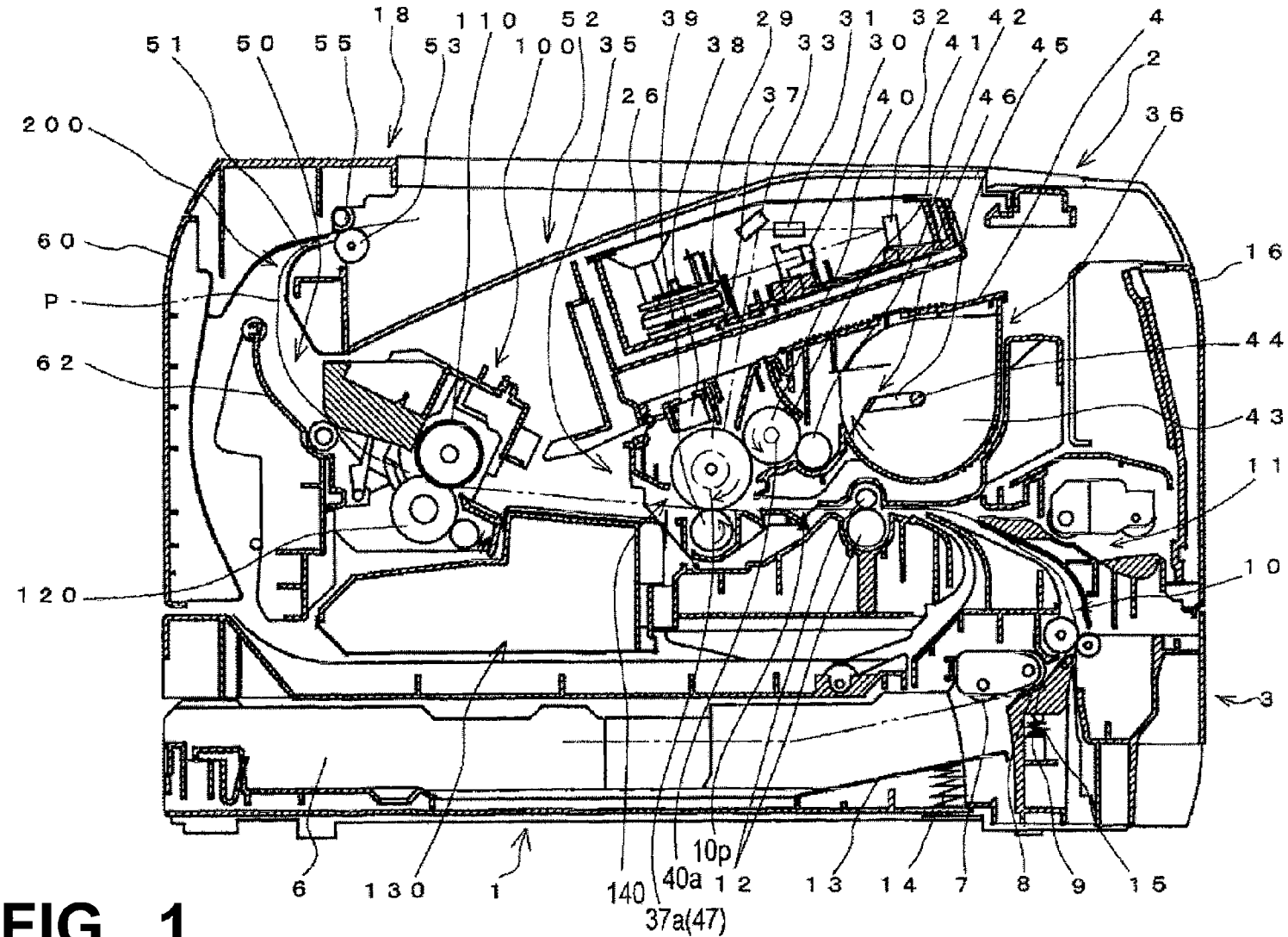
FIG. 1 is a schematic sectional side view of a laser printer.

It is noted that various connections are set forth between elements in example structures in the following description. It is noted that these connections in general and, unless specified otherwise, may be direct or indirect and that this specification is not intended to be limiting in this respect.

I. General Description of Devices According to at Least Some Examples of the Invention Aspects of this invention relate to image forming apparatuses and process units or other devices included in such apparatuses (e.g., process units including a photosensitive drum cartridge (optionally with a photosensitive drum) and/or a developing cartridge (optionally with a developing roller and/or a developer supply hopper)). Image forming apparatuses according to at least some examples of this invention will include: (a) a developing cartridge engagement that supports a developing cartridge; and (b) a photosensitive drum engagement that engages a photosensitive drum cartridge.

The developing cartridge may be equipped with: a first protrusion element that engages the developing cartridge at a mounting position with the photosensitive drum cartridge; a second protrusion element that inhibits rotation of the developing cartridge by engaging the developing cartridge engagement when the process unit is in a process unit mounting position; and a third protrusion element for inhibiting rotation of the photosensitive drum cartridge relative to the image forming apparatus when the process unit is in the process unit mounting position. The protrusion elements may be located on exterior walls that support the ends of the developing roller in the developing roller cartridge. The photosensitive drum cartridge may be equipped with a fourth protrusion element located on the exterior walls that support the ends of the photosensitive drum. The fourth protrusion element may be used to lock the photosensitive drum cartridge relative to the image forming apparatus by engaging the photosensitive drum engagement when the process unit is in the process unit mounting position. Finally, the photosensitive drum cartridge further may include a rotation inhibiting component that inhibits rotation of the photosensitive drum in relation to the image forming apparatus by engaging the third protrusion element of the developing cartridge.

Additional aspects of the invention relate to process units that may be included in or used with image forming apparatuses of the types described above. Such process units may include one or more of the developing cartridges and/or the photosensitive drum cartridges described above.

Still additional aspects of this invention relate to developing cartridges configured to be combined with photosensitive drum cartridges, process units including such developing cartridges and/or photosensitive drum cartridges, and/or image forming apparatuses including such process units, photosensitive drum cartridges, and/or developing cartridges. Photosensitive drum cartridges used in accordance with at least some examples of this aspect of the invention may include a first alignment member, e.g., that engages an interior surface of an image forming apparatus in which it is mounted. Developing cartridges according to at least some of these example aspects of the invention may include: (a) a toner supply hopper and/or a toner supply; and (b) a second alignment member that may be aligned, for example, by at least one of the inside surfaces of an image forming apparatus in which it is mounted. The developing cartridge and the photosensitive drum cartridge may be secured together prior to insertion into the image forming apparatus or after insertion into the image forming apparatus. Additionally or alternatively, in at least some examples of this invention, the developing cartridge may be required to properly align the photosensitive drum cartridge in the image forming apparatus.

II. Detailed Description of Example Systems and Methods According to the Invention Various example embodiments of the present invention shall be explained in more detail below and based on the drawings.

Embodiment 1

FIG. 1 is a schematic sectional side view of a laser printer 1, which is used to illustrate one example of an image forming apparatus according to the present invention.

As shown in FIG. 1, the example laser printer 1 includes: a paper feed 3 for the purpose of feeding paper P, a process unit 4 that operates as an image forming component (e.g., forms a developer image that is a visible image on the paper P that is fed), a fixing unit 100 that fixes the developer image that has been formed on the paper P, and a paper eject 200 that ejects the paper P that has passed through the fixing unit 100, etc. These systems are provided within a body casing 2 that includes a top cover 18, a front cover 16, and a rear cover 60, etc. Furthermore, in the present example printer structure 1, the rear cover 60 is considered to be the "rear" and the front cover 16 is considered to be the "front."

The paper feed 3 is equipped with a paper cassette 6, feed rollers 7 and 8 (which are provided on top of the (front) end of the leading edge in the transport direction of the paper P that is stacked within the paper cassette 6 in this example arrangement), and feed pad 9. In addition, a feed path 10 that is the transport pathway for the paper P and that is for the purpose of reversing the paper P supplied from the feed cassette 6 and transporting it to the lower part of the process unit 4 is established at the paper feed 3. Furthermore, this paper feed 3 is equipped with a resist roller pair 12 that faces the feed path 10. In addition to the paper P that is within the feed cassette 6, paper P that is manually set in the manual feed tray 11 is fed, and in either case, after the paper P is temporarily paused at the resist roller pair 12, it is fed to the process unit 4 according to the timing of image formation at the process unit 4.

The feed cassette 6 is mounted on the process unit 4 and the lower part of the fixing unit 100 so that it can be inserted into and removed from the front of the body casing 2. Paper pressure plate 13 and spring 14 are provided within the feed cassette 6. The paper pressure plate 13 is supported at the end farthest from the feed roller 7, etc., so that it can move (e.g., oscillate, rotate, pivot, etc.), and the near end is made so that it can move up and down. In addition, the spring 14 is arranged so that it biases the paper pressure plate 13 upward or downward at the rear surface of the end near the feed roller 7, etc., at the paper pressure plate 13.

The feed roller 8 and the feed pad 9 are arranged so that they face each other. Also, the feed pad 9 is pressed in the direction of the feed roller 8 by a spring 15 that is provided at the rear of the feed pad 9. Of the paper P that is stacked on the paper pressure plate 13, the paper P that is in the top-most position is pressed into contact with the feed roller 7 because the paper pressure plate 13 receives an upward force from the spring 14 on its rear. Also, after the paper P that is in the top-most position begins to be transported by the feed roller 7 and becomes sandwiched between the feed roller 8 and the feed pad 9, it is reliably separated from any other paper P at the feed roller 8 and the feed pad 9 accompanying the rotation of the feed roller 8, and it is fed in the direction of the feed path 10.

Also, the paper P that is fed in the direction of the feed path 10 is sent to the resist roller pair 12 that is provided at the upper part of the feed roller 7, etc. Also, after the paper P is resisted by the resist roller pair 12, it may be passed through a transport path 10*p* that is formed from a paper transport rim (not shown in the figure) inside the body casing 2 and a processing side paper transport rim 27 (refer to FIG. 2) that is provided at the developing cartridge 36. The paper P then may be transported between the photosensitive drum 37 and the transfer roller 39.

The scanning unit 26 located on the upper part of the process unit 4 is equipped with a laser emission component (not shown in the figure), a polygon mirror 29 that is rotary driven at high speed, a first scanning lens (fθ lens) 30, a second scanning lens (a cylindrical lens) 31, and reflecting mirrors 32 and 33, etc. Also, the laser beam projected from the laser emission component is modulated based on the image information, and as shown with the two-dot chain line in FIG. 1, it sequentially advances via the polygon mirror 29, the first scanning lens 30, the reflecting mirror 32, the second scanning lens 31, and the reflecting mirror 33. The laser beam exposes and scans the surface of the photoreceptor drum 37 within the process unit 4.

The process unit 4 is equipped with a photosensitive drum cartridge 35 and a developing cartridge 36. Furthermore, the photosensitive drum cartridge 35 is equipped with a photosensitive drum 37, a charger 38, and a transfer roller 39. In addition, the developing cartridge 36 is structured so that it can be attached to and removed from the photosensitive drum cartridge 35, and it is equipped with a developing roller 40, a thickness regulating blade 41, a feed roller 42, and a toner hopper 43, etc.

The developing roller 40 of the developing cartridge 36 is composed of a metal developing roller axis 40*a* (which also optionally may function as an alignment member or positioning component for the developing roller 40 and/or its cartridge 36), and a roller composed of an electrically conductive rubber material that covers the developing roller axis 40*a*. The developing roller 40 is rotary driven in the counterclockwise direction in the view shown in FIG. 1. Furthermore, the developing roller 40 is configured so that a developing bias may be applied thereto.

A thickness regulating blade 41 is provided in the vicinity of the developing roller 40. The thickness regulating blade 41 is equipped with a blade unit composed of a metal plate-spring, and furthermore, the leading edge of this blade unit is equipped with a pressing component having a semicircular cross-section and composed of an insulating silicone rubber. Also, this pressing component is structured so that it is pressed against the top of the developing roller 40 by means of the elastic force of the blade unit.

In addition, developer inside of the hopper 43 is stirred by the clockwise rotation of an agitator 45 that is supported by the rotation axis 44, and the developer is discharged from the supply port 46 that opens at the side of the hopper 43. Incidentally, the feed roller 42 is rotatably mounted on the side of the supply port 46, and moreover, the previously described developing roller 40 is rotatably mounted facing the feed roller 42. The feed roller 42 and the developing roller 40 are each in contact with the other in this example structure in a state such that they can be compressed to a certain degree.

Developer discharged from the supply port 46 is supplied to the feed roller 42, and it is also supplied to the developing roller 40 accompanying the rotation of the feed roller 42. At this time the developer is friction-charged between the feed roller 42 and the developing roller 40 so that it becomes positively charged. Also, the developer that is supplied onto the developing roller 40 passes between the pressing component of the thickness regulating blade 41 and the developing roller 40 accompanying the rotation of the developing roller 40, and in this manner, developer is supported on the developing roller 40 as a thin layer of a prescribed thickness.

The photosensitive drum 37 of the photosensitive drum cartridge 35 is composed of a drum axis 37*a* and a drum unit that covers the drum axis 37*a*, and it is supported at the side of the developing roller 40 so that it faces the developing roller 40 and so that it can rotate clockwise. Furthermore, a positively charged photosensitive layer (e.g., that is composed of polycarbonate, etc.) is formed on the surface of the drum unit.

A charger 38 is provided facing the photosensitive drum 37 from a prescribed distance diagonally to the upper left of the photosensitive drum 37. The charger 38 of this example arrangement is a positively charged Scorotron type charger that emits a corona discharge from a charging wire made of tungsten, etc., and it is configured to positively charge the surface of the photoreceptor drum 37 uniformly.

At the bottom of the photosensitive drum 37, a transfer roller 39 is provided such that it faces the photosensitive drum 37, and it is supported so that it can rotate counterclockwise. The transfer roller 39 is composed of a metal roller axis and a roller composed of an electrically conductive rubber material that covers the metal roller axis. Also, the transfer roller 39 is structured and arranged so that a transfer bias may be applied to it at the time of developer image transfer to the paper P.

In use, the surface of the photosensitive drum 37 is first uniformly positively charged by the charger 38 accompanying the rotation of the photosensitive drum 37. Next, the surface is exposed by the laser beam from the scanning unit 26, and an electrostatic latent image is formed. Also, when the photosensitive drum 37 is rotary driven relative to the developing roller 40, the developer that is supported on the developing roller 40 and positively charged is supplied to the photosensitive drum 37 by means of the developing bias applied to the developing roller 40. Specifically, on the surface of the photosensitive drum 37 that is uniformly positively charged, developer is supplied to the exposed part that has been exposed by the laser beam and that has a lower electrical potential, that is to say, the part corresponding to the electrostatic latent image. In this manner, the developer image is formed and supported on the photosensitive drum 37.

Thereafter, the developer that is supported on the surface of the photosensitive drum 37 is transferred to the paper P by means of the transfer bias applied to the transfer roller 39 while the paper P is passing between the photosensitive drum 37 and the transfer roller 39.

The fixing unit 100 is on top of the feed cassette 6 and on the side of the process unit 4, and it is located so that it is farther downstream in the transport direction of the paper P than the process unit 4. The fixing unit 100 is equipped with a heating roller 110, which is equipped with a heater composed of a halogen lamp, for example, and a pressure roller 120 that is located so that it faces the heating roller 110 and presses against the surface of the heating roller 110.

Pressure roller 120 has a PTFE (polytetrafluoroethylene) film wrapped on an elastic surface, such as a silicone rubber surface, at the roller axis (not shown). Also, this pressure roller 120 drives the heating roller 110 in a state where it is pressed against the heating roller 110.

With this fixing unit 100, the developer that has been transferred onto the paper P at the process unit 4 is heat fixed to the paper P while the paper P is held between the heating roller 110 and the pressure roller 120 and transported. Then, after this, the paper P is sent to the paper ejection path 50, and it is ejected onto the paper ejection tray 52 via the paper ejection roller pairs 53 and 55.

Figure 2:
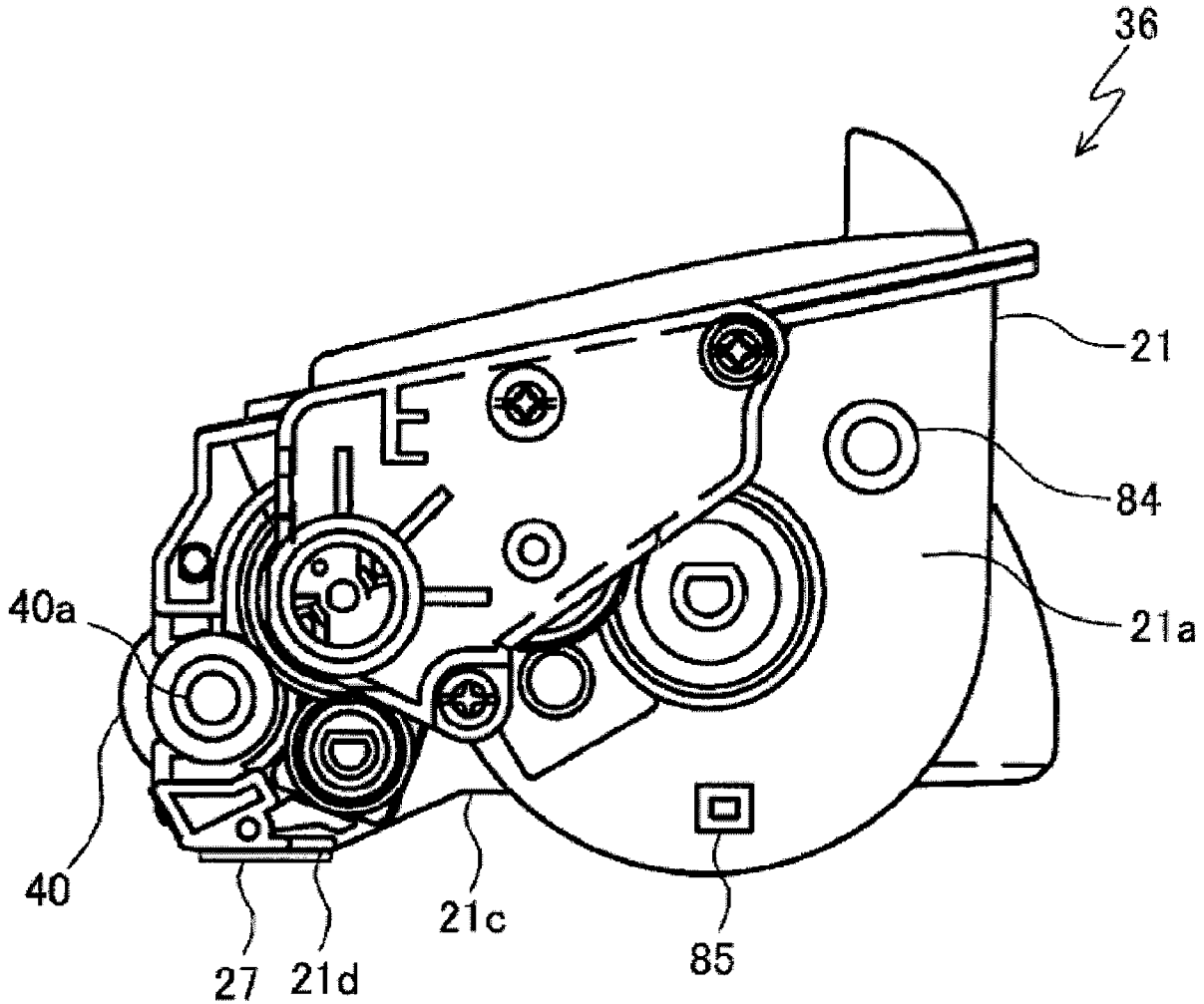
FIG. 2 is a side view of a developing cartridge in accordance with aspects of the present invention.
Figure 3:
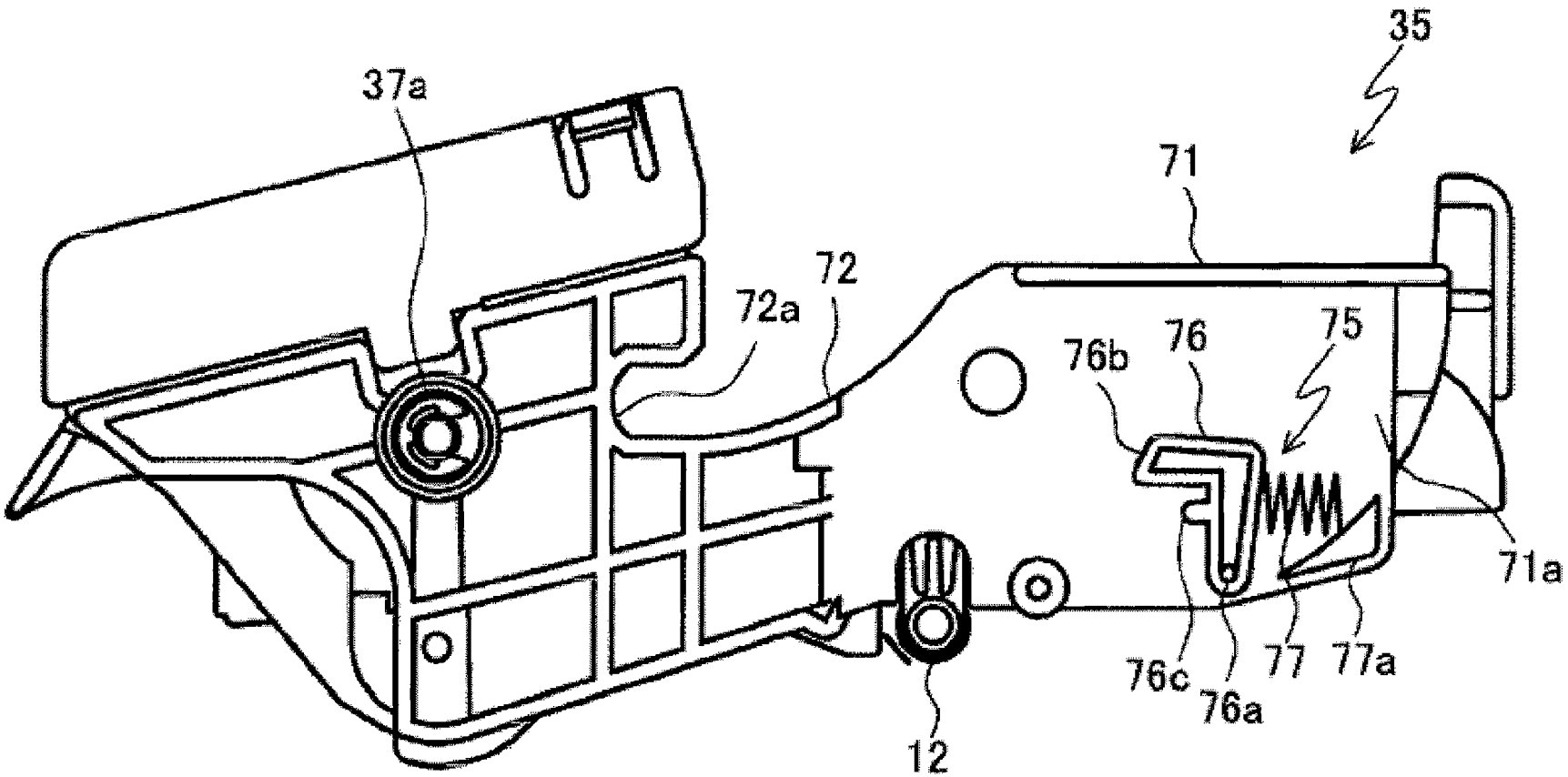
FIG. 3 is a side view of a photosensitive drum cartridge in accordance with aspects of the present invention.
Figure 4:
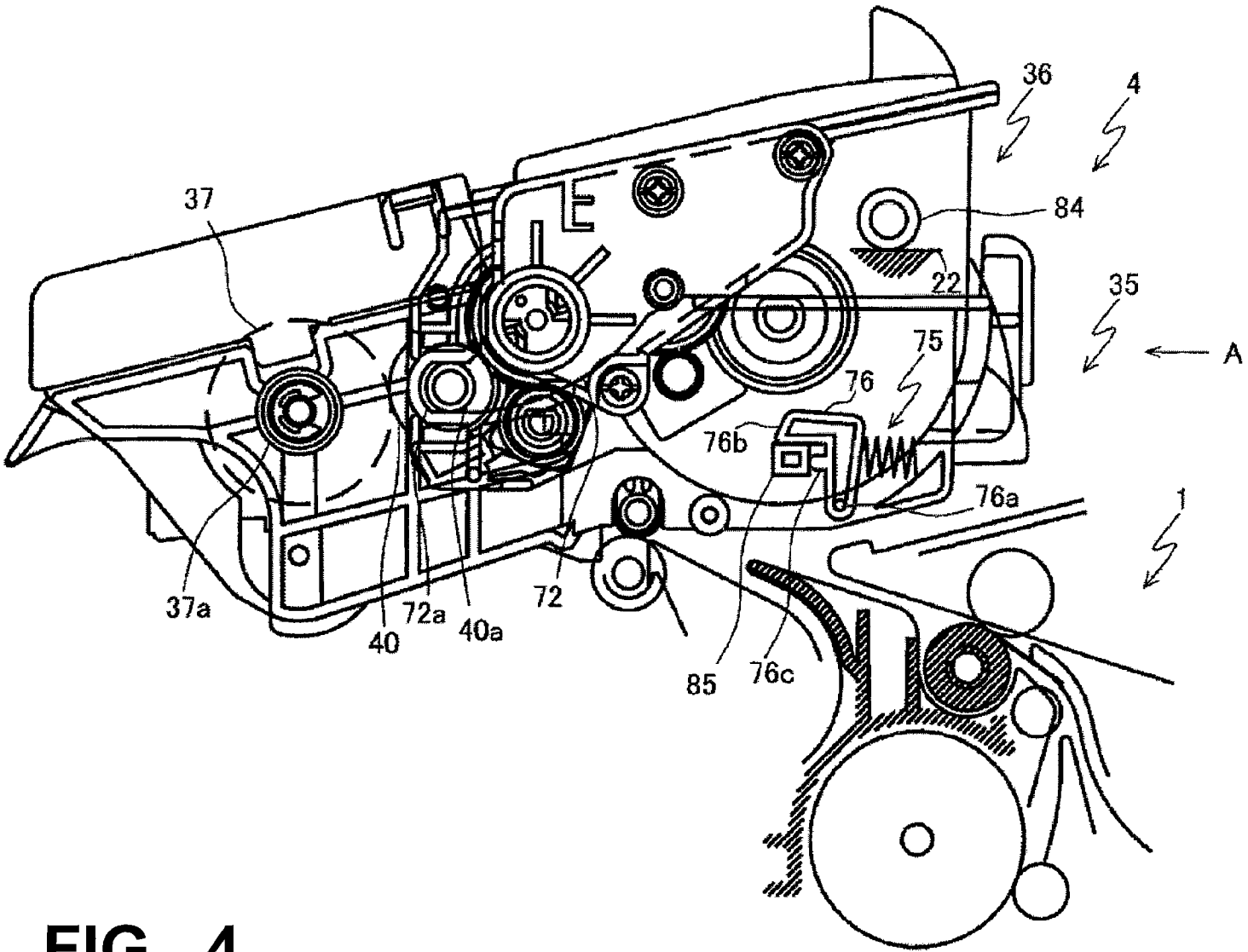
FIG. 4 is a side view of a process unit in accordance with aspects of the present invention.
Figure 5:
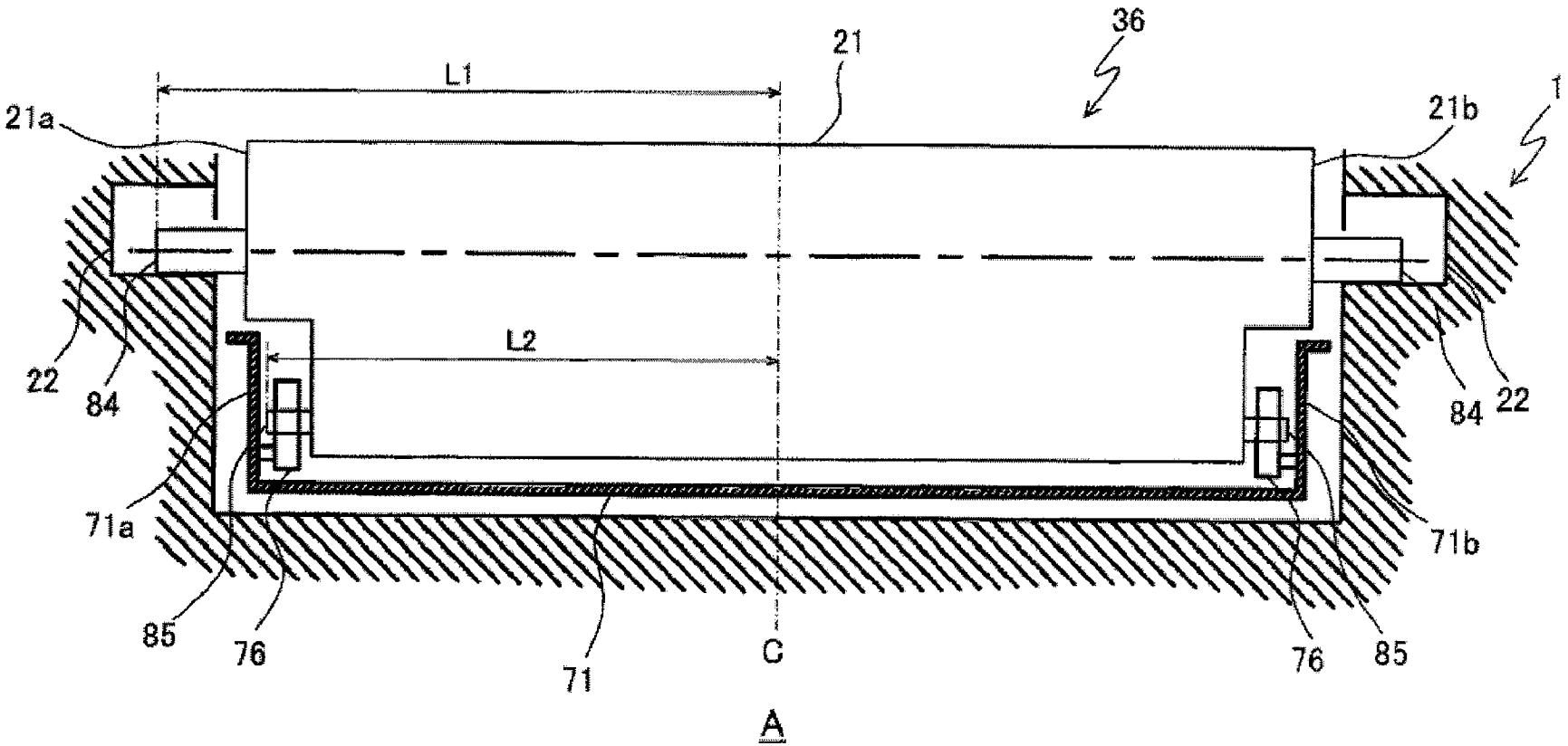
FIG. 5 is a front view of a process unit in accordance with aspects of the present invention.
Figure 6:
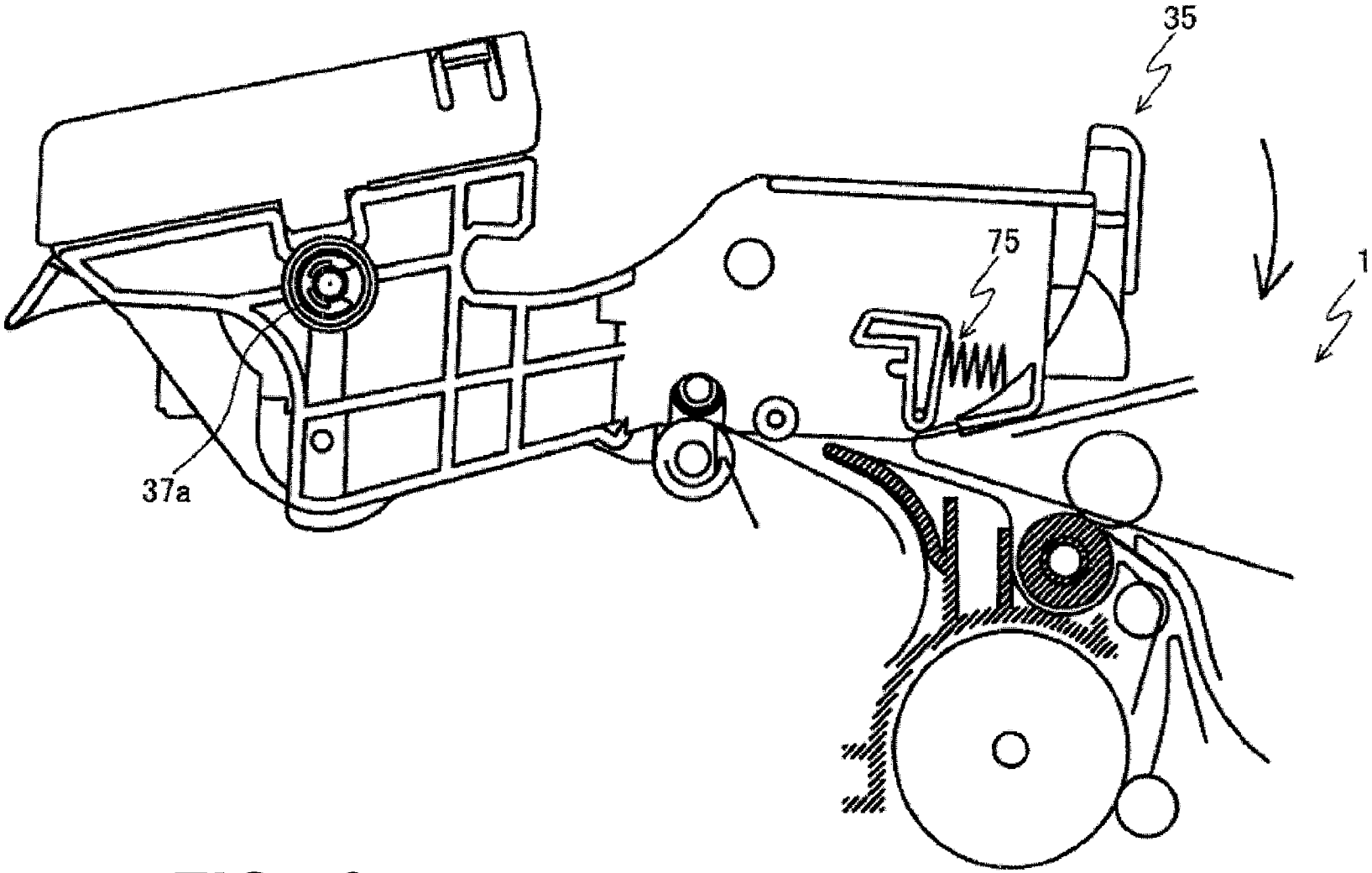
FIG. 6 is an explanatory drawing that explains the photosensitive drum cartridge mounting operation in accordance with aspects of the present invention.

Next, the configuration and mounting structures and procedures of the developing cartridge 36 and the photosensitive drum cartridge 35 shall be explained in relation to the mounting of the developing cartridge 36 and the photosensitive drum cartridge 35 in the laser printer 1 using FIGS. 2-6. Here, FIG. 2 is a side view of the developing cartridge 36, FIG. 3 is a side view of the photosensitive drum cartridge 35, FIG. 4 is a side view of the process unit 4, FIG. 5 is a front view of the process unit 4, and FIG. 6 is a side view of the photosensitive drum cartridge 35 in a state where it has been mounted relative to the laser printer 1.

As shown in FIGS. 2 and 5, the developing cartridge 36 is equipped with an alignment member or positioning component 84 that protrudes in a column or cylinder shape at the side walls 21*a* and 21*b* of the developing cartridge side chassis 21. These positioning components 84 engage with the developing cartridge engagement 22 that is provided in the laser printer 1. Positioning components 84 are located at the side walls 21*a* and 21*b* on the developing cartridge 36 toward an opposite direction from a mounting direction of the developing cartridge 36 (that is to say, the positioning component(s) 84 are located toward the front of the developing cartridge 36). In addition, a rotation inhibiting protrusion component 85 that protrudes in the shape of a rectangular column engages with a rotation inhibiting element 76 (to be described in more detail later) of the photoreceptor cartridge 35 (refer to FIG. 3) in the vicinity of the bottom of the side walls 21*a* and 21*b*. Furthermore, as shown in FIG. 5, the positioning components 84 protrude to positions that are farther from the central axis C that passes through the center of the developing cartridge 36 as compared to the position of the inhibiting protrusion component 85 with respect to central axis C. In other words, as illustrated in FIG. 5, L1>L2.

In addition, a developing cartridge side paper transport rim 27 that is adjacent to a paper transport rim (not shown in the figure) of the body casing 2 and that forms the transport path 10*p* for the paper P (refer to FIG. 1) is provided at the rear end 21*d* of the base wall 21*c* at the developing cartridge side chassis 21 when the process unit 4 or developing cartridge 36 is mounted within the body casing 2 of the laser printer 1.

Next, as shown in FIGS. 3 and 5, the photosensitive drum cartridge 35 is equipped with a photosensitive drum side chassis 71 and with a guide 72 that is in contact with the developing roller axis 40*a*. The guide 72 guides the developing roller 40 (refer to FIGS. 3 and 4) and provides an engagement 72*a* where the developing roller axis 40*a* is engaged. The guide 72 and engagement 72*a* are formed on the upper side near the center of the photosensitive drum cartridge side chassis 71. In addition, the photosensitive drum cartridge 35 is equipped with an inhibiting device 75 that includes a rotation inhibiting element 76 that engages with the inhibiting protrusion component 85 of the developing cartridge 36. The inhibiting device 75 is provided on the internal surfaces of the side walls 71*a* and 71*b* that are located on both sides of the photosensitive drum cartridge side chassis 71. The inhibiting device 75 is equipped with a coil spring 77 in addition to the rotation inhibiting element 76 previously described. One end of this coil spring 77 is connected to a spring mount 77*a* that is located near the front, lower end of the photosensitive drum cartridge 35.

The rotation inhibiting element 76 of this example configuration forms an approximate L shape, with one end of the "L" supported rotatably by a turning axis 76*a* located close to the rear end of the previously described spring mount 77*a*, and the other end of the "L" located so that it faces in the direction of the photosensitive drum 37. In addition, a protrusion 76*c* that protrudes in the direction of the photosensitive drum 37 is formed on the interior surface (the side of the "L" forming an interior angle) of the rotation inhibiting element 76. In addition, a taper 76*b* is formed in the vicinity of the leading edge of the rotation inhibiting element 76 facing in the direction of the photosensitive drum 37.

As described previously, one end of the coil spring 77 is connected to the spring mount 77*a*, and the other end is connected to the surface of the rotation inhibiting element 76 opposite the surface where the protrusion 76*c* is formed. In this manner, the rotation inhibiting element 76 is pressed toward the side of the photosensitive drum 37 by the biasing force of the coil spring 77.

Next, examples of the mounting structures and operations for the photosensitive drum cartridge 35 and the developing cartridge 36 shall be explained.

First, the photosensitive drum cartridge 35 may be inserted into the body casing 2 of the laser printer 1, and specifically, the drum axis 37*a* of the photosensitive drum cartridge 35 may be engaged with the photosensitive drum engagement 47 that is established within the casing 2 (refer to FIG. 1). Having done this, the photosensitive drum cartridge 35 may be locked into the engagement position using the drum axis 37*a* and the photosensitive drum engagement 47 (if desired, additional locking elements or mechanisms may be provided). Furthermore, the drum axis 37*a* may be arranged so as to rotate in relation to the photosensitive drum engagement 47, and as shown in FIG. 6, the photosensitive drum cartridge 35 is in a state where it may be rotated centered on the drum axis 37*a* when it is arranged in the state where only the drum axis 37*a* is engaged with the photosensitive drum engagement 47. In other words, at this time, the front of the photosensitive drum cartridge 35 is in a state where it can swing and/or is depressed downward under its own weight.

The developing cartridge 36 then may be inserted into the body casing 2. When this is done, the developing roller axis 40*a* of the developing cartridge 36 comes into contact with the guide 72 of the photosensitive drum cartridge 35 (refer to FIGS. 3 and 4). Then, after this, the developing roller axis 40*a* (that is to say, the developing cartridge 36) is guided to the side of the photosensitive drum 37 following the guide 72, and the developing roller axis 40*a* engages with the engagement 72*a* that is provided on the closed end of the guide 72 as shown in FIG. 4. In this manner, the developing cartridge 36 becomes engaged in the mounting position. Furthermore, it is also acceptable to mount a resin collar, etc., on the developing roller axis 40*a*. Also, the developing roller axis 40*a* rotates in relation to the engagement 72*a*, and the developing cartridge 36 may be arranged in a state where it rotates centered on the developing roller axis 40*a* when it is in the state where only the developing roller axis 40*a* is engaged with the engagement 72*a*.

Next, in the present example embodiment, the developing cartridge 36 is positioned so that it cannot rotate relative to the body casing 2. As described previously, the developing cartridge engagement 22 (refer to FIG. 5) is established at body casing 2, and the positioning component 84 of the developing cartridge 36 engages with the developing cartridge engagement 22. Specifically, when the developing roller axis 40*a* has been engaged with the engagement 72*a*, the front part of the developing cartridge 36 hangs downward. Having done this, as shown in FIG. 4, the positioning component 84 comes into contact with the developing cartridge engagement 22, and the developing cartridge 36 is positioned so that it cannot rotate.

As another example, it is also acceptable to give the developing cartridge engagement 22 a groove shape and to structure the positioning component 84 so that it joins with this groove. As yet another example, it is also acceptable to make the developing cartridge engagement 22 into a through-hole, and also to structure the positioning component 84 so that it can enter into or withdraw from the developing cartridge side chassis 21, and to make it so that the developing cartridge 36 is positioned relative to the body casing 2 by inserting the positioning component 84 via the developing cartridge side chassis 21 at the mounting position of the developing cartridge 36 and inserting it into the through-holes. Other mounting structures, arrangements, and methods also are possible without departing from this invention.

The photosensitive drum cartridge 35 then is positioned so that it cannot rotate. First, the front part of the photosensitive drum cartridge 35 moves to approach the front side of the developing cartridge 36. In other words, the front part of the photosensitive drum cartridge 35 is lifted. The front part of the photosensitive drum cartridge 35 can be accessed via an aperture that is used to attach and remove the process unit 4 at the body casing 2. Having done this, when the front part is lifted to a prescribed position, the inhibiting protrusion component 85 of the developing cartridge 36 comes into contact with the taper 76*b* of the rotation inhibiting element 76 of the inhibiting device 75 of the photosensitive drum cartridge 35.

When the photosensitive drum cartridge 35 is further lifted, the taper 76*b* and the inhibiting protrusion component 85 slide with respect to one another, and the rotation inhibiting element 76 is rotated so that it is pushed to the inhibiting protrusion component 85 by means of the sliding. Also, ultimately, the state where the inhibiting protrusion component 85 and the taper 76*b* of the rotation inhibition element 76 are in contact is ended, the rotation inhibiting element 76 is rotated counterclockwise by the biasing force of the coil spring 77, and as shown in FIG. 4, both are engaged so that the rotation inhibiting element 76 holds the inhibiting protrusion component 85. At this time, the rotation inhibiting element 76 is engaged so that the inhibiting protrusion component 85 hangs down, and also the protrusion 76*c* of the rotation inhibition element 76 is in contact with the inhibiting protrusion component 85 due to the biasing force of the coil spring 77.

It is also acceptable to engage the developing cartridge 36 and the photosensitive cartridge 35 to make them together form the process unit 4 (in other words, the developing roller axis 40*a* may be engaged with the engagement 72*a* and also the rotation inhibiting element 76 may be engaged with the inhibiting protrusion component 85) external to the body casing 2, and then to mount the process unit 4 within the body casing 2.

In this way, by engaging the rotation inhibiting element 76 with the inhibiting protrusion component 85, the photoreceptor cartridge 35 is positioned so that it cannot rotate relative to the body casing 2. In addition, the inhibiting protrusion component 85, that is to say the developing cartridge 36, is pushed toward the side of the photosensitive drum 37 because the coil spring 77 pushes the rotation inhibiting element 76 toward the side of the photosensitive drum 37.

The engagement of the rotation inhibiting element 76 and the inhibiting protrusion component 85 can be released by operating a lever (not shown in the figure) that is connected to the rotation inhibiting element 76 and rotating the rotation inhibiting element 76 clockwise centered on the rotation axis 76*a* and against the biasing force of the coil spring 77.

As described above, in the laser printer 1 of the present example embodiment, the developing cartridge 36 is positioned so that it cannot rotate in the laser printer 1 without involving the photosensitive drum cartridge 35. For this reason, the amount of displacement of the photosensitive drum cartridge 35 relative to the laser printer 1 is not added to the amount of displacement of the developing cartridge 36 relative to the laser printer 1, and the developing cartridge 36 can be mounted in the laser printer 1 with good precision. Therefore, the space of the transport path 10*p* (refer to FIG. 1) that is formed at least in part by the developing cartridge side paper transport rim 27 of the developing cartridge 36 and the paper transport rim (not shown) provided at the body casing 2 of the laser printer 1 does not become too narrow or too wide, so the paper P can be reliably and smoothly transported. Therefore, it is possible to prevent or reduce the occurrence of errors, such as paper jams.

In addition, as described above, the coil spring 77 of the photosensitive drum cartridge 35 biases the inhibiting protrusion component 85 toward the side of the photosensitive drum 37 via the rotation inhibiting element 76. In other words, the developing roller 40 is pressed toward the side of the photosensitive drum 37. Therefore, the developing roller 40 and the photosensitive drum 37 are pressed into contact, and developer can be reliably supplied from the developing roller 40 to the photosensitive drum 37. In this manner, it is possible to improve the quality of printing.

In the example embodiment described above, the developing roller axis 40*a* corresponds to (or also may be referred to as) the first protrusion, the positioning component 84 corresponds to (or also may be referred to as) the second protrusion, the inhibiting protrusion component 85 corresponds to (or also may be referred to as) the third protrusion, the drum axis 37*a* corresponds to (or also may be referred to as) the fourth protrusion, and the coil spring 77 corresponds to (or also may be referred to as) the biasing means. Of course, other structural features and arrangements may be used to perform the various functions described herein for these various elements without departing from this invention.

Embodiment 2

Figure 7:
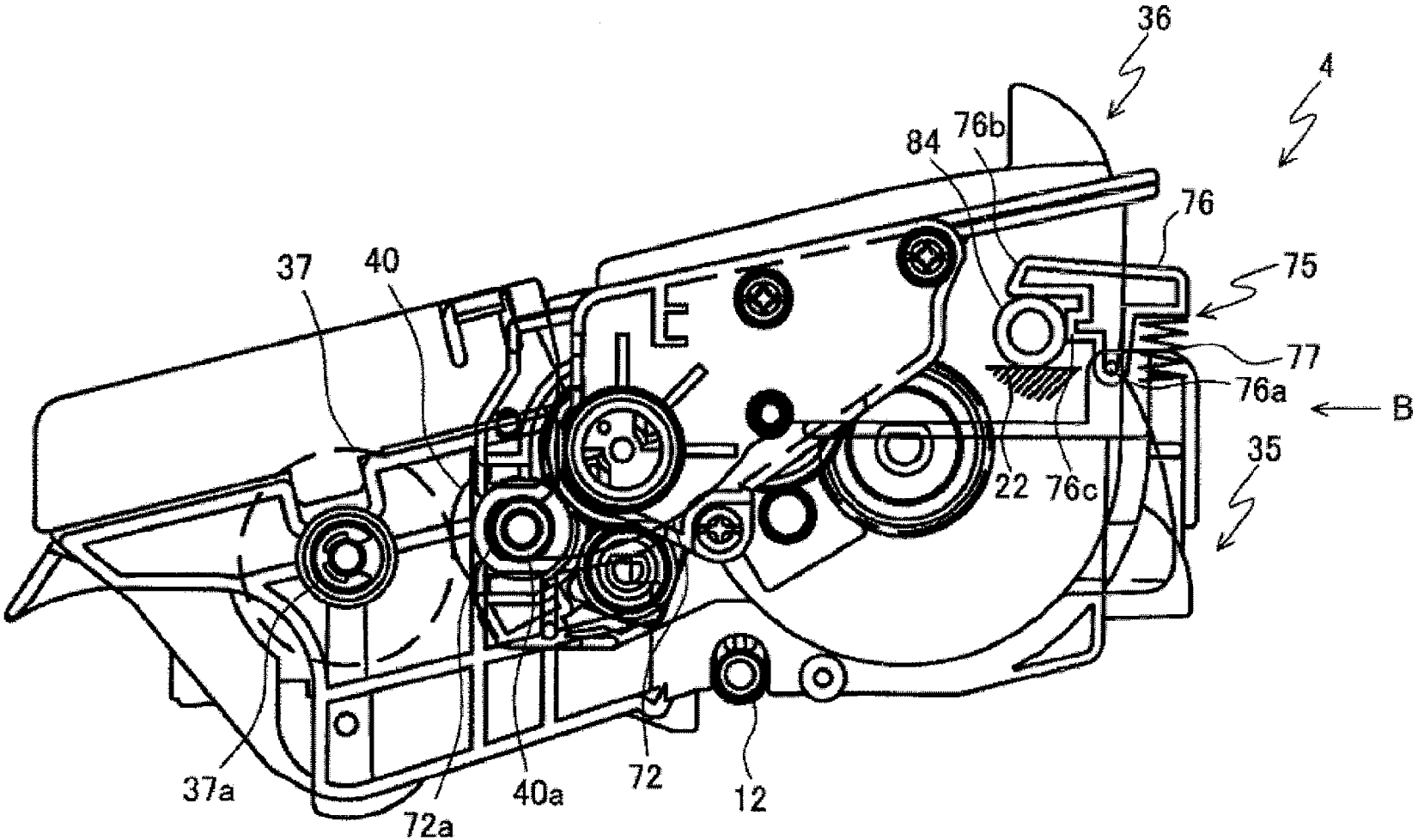
FIG. 7 is a side view of a process unit of a second example embodiment in accordance with aspects of the present invention.
Figure 8:
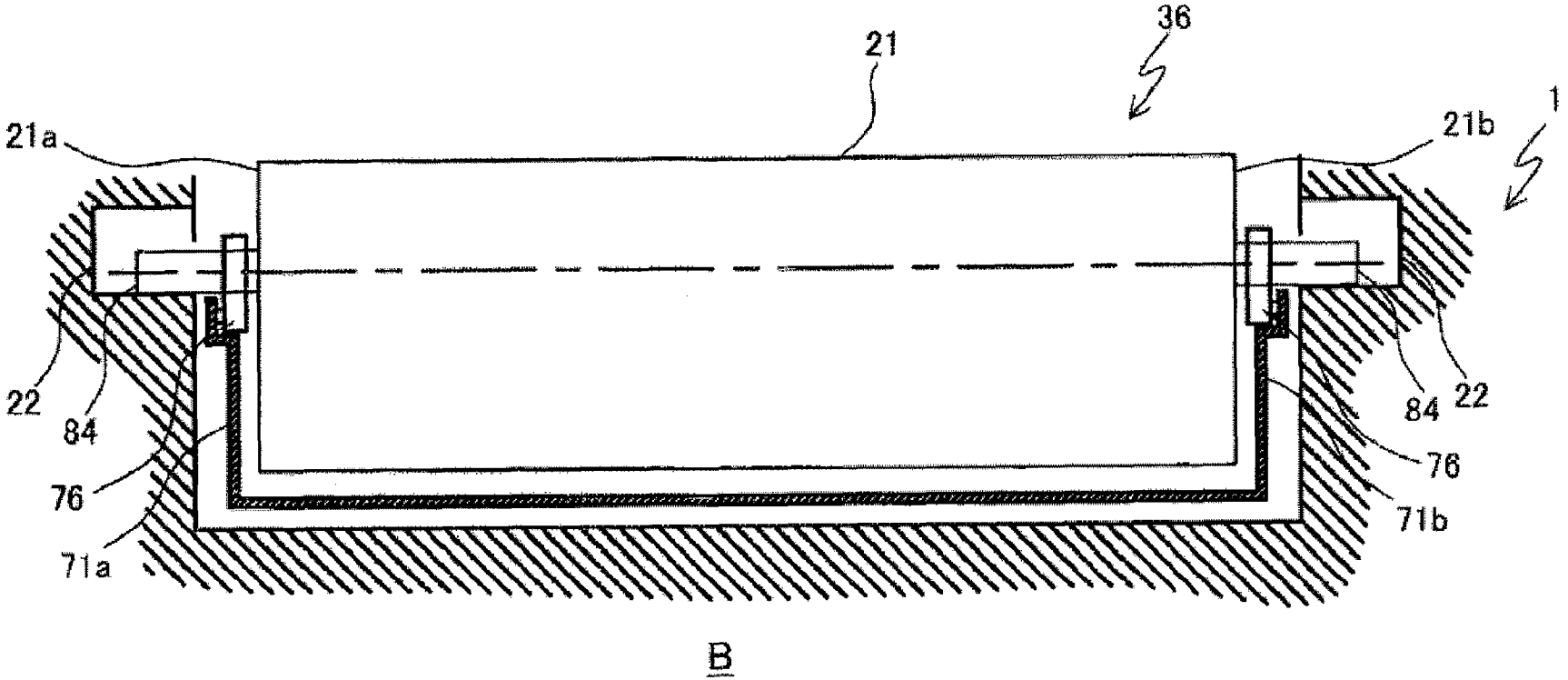
FIG. 8 is a front view of the process unit of the second example embodiment in accordance with aspects of the present invention.
Figure 9:
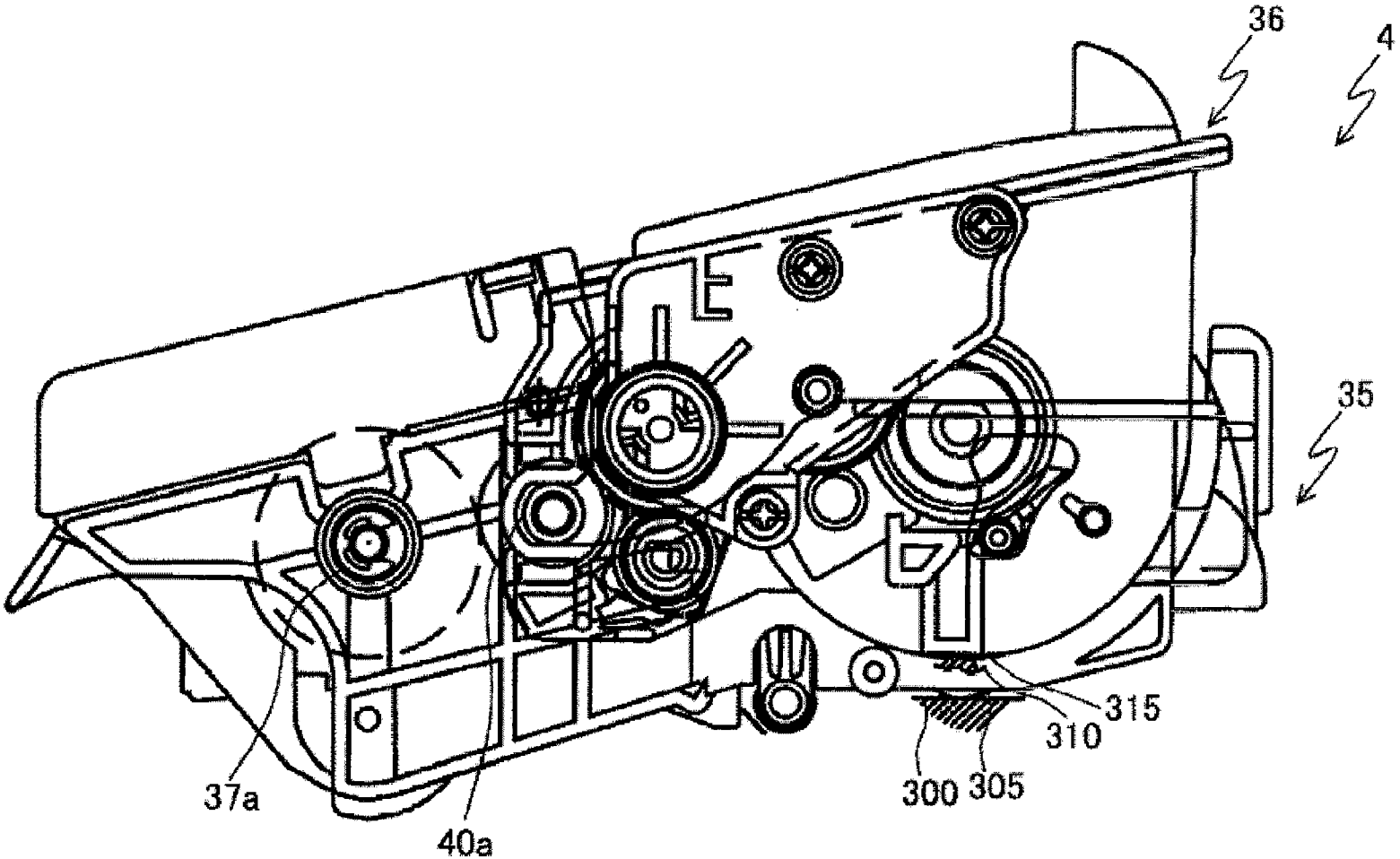
FIG. 9 is an explanatory drawing that explains conventional processing units and laser printers.

Next, a laser printer 1 of a second example embodiment according to this invention shall be explained using FIGS. 7 and 8.

As shown in FIGS. 7 and 8, with the laser printer 1 in this example embodiment, the positioning component 84 of the developing cartridge 36 that engages with the developing cartridge engagement 22 of the laser printer 1 is configured so that it also engages with the rotation inhibiting element 76 of the photosensitive drum cartridge 35. Therefore, because the positioning component 84 engages with the developing cartridge engagement 22, the developing cartridge 36 is positioned so that it cannot move relative to the laser printer 1. Also, because the rotation inhibiting element 76 of the photosensitive drum cartridge 35 is engaged with the positioning component 84, the photosensitive drum cartridge 35 is positioned so that it cannot move relative to the laser printer 1. Furthermore, in this second example embodiment, the shape of the rotation inhibiting element 76 and the manner of connecting the coil spring 77 differ compared to those of the first example embodiment, but the general principle and operation are the same, so a detailed explanation shall be omitted.

According to this second example embodiment, as compared with the first example embodiment, it is possible to avoid inclusion of a separate protrusion component 85. Therefore, it is possible to simplify the structure, and costs can be reduced as well.

As yet additional examples, it is acceptable to separately establish or provide an element as the first protrusion element without structuring the processing roller axis 40*a* as the first protrusion element. In addition or as another alternative, it is also acceptable to separately establish or provide an element as the fourth protrusion element without structuring the drum axis 37*a* as the fourth protrusion element.

While various example embodiments and structures according to examples of the present invention have been explained above, those skilled in the art will recognize that the present invention is not limited to the various examples and embodiments described above. A wide variety of structures, arrangements, and embodiments can be employed within the technical scope of and without departing from the present invention.

I claim:

1. An image forming apparatus, comprising:

a developing cartridge engagement;

a photosensitive drum cartridge engagement; and a process unit attachable to and detachable from the image forming apparatus, wherein the process unit includes a photosensitive drum cartridge and a developing cartridge, wherein said developing cartridge is equipped with:

a developing roller that supplies developer to the photosensitive drum cartridge, a feed roller that supplies developer to the developing roller, a first protrusion element that engages said developing cartridge into a mounting position on said photosensitive drum cartridge, a second protrusion element that inhibits rotation of said developing cartridge about said first protrusion element by engaging said developing cartridge engagement when said process unit is in a process unit mounting position in said image forming apparatus, and a third protrusion element for inhibiting rotation of said photosensitive drum cartridge relative to said image forming apparatus when said process unit is in said process unit mounting position, wherein said first through third protrusion elements are provided on an exterior of two walls of said developing cartridge that support both ends of said developing roller rotatably in said developing cartridge, wherein said photosensitive drum cartridge is equipped with:

a photosensitive drum, a fourth protrusion element located on an exterior of two walls of said photosensitive drum cartridge that support both ends of said photosensitive drum rotatably in said photosensitive drum cartridge, wherein said fourth protrusion element locks said photosensitive drum cartridge relative to said image forming apparatus by engaging said photosensitive drum cartridge engagement when said process unit is in said process unit mounting position, and a rotation inhibiting component that inhibits rotation of said photosensitive drum cartridge about said fourth protrusion element in relation to said image forming apparatus by engaging with the third protrusion element of said developing cartridge, and wherein the developing cartridge is attachable to and detachable from the photosensitive drum cartridge.

2. An image forming apparatus according to claim 1, wherein said second protrusion element is located on the developing cartridge in an opposite direction from a mounting direction of said developing cartridge relative to said photosensitive drum cartridge.

3. An image forming apparatus according to claim 1, wherein said rotation inhibiting component is connected to a biasing means, and wherein said third protrusion element is configured such that said third protrusion element is pressed down by a biasing force of said biasing means via said rotation inhibiting element in a direction where said third protrusion element presses said developing roller into contact with said photosensitive drum.

4. An image forming apparatus according to claim 1, wherein said second protrusion element protrudes to a position that is even farther from a center of said developing cartridge than said third protrusion element.

5. An image forming apparatus according to claim 1, wherein said second protrusion element and said third protrusion element extend in parallel directions.

6. An image forming apparatus according to claim 1, wherein said first protrusion element is established on a rotation axis of said developing roller.

7. A process unit, comprising:

a photosensitive drum cartridge and a developing cartridge engaged with the photosensitive drum cartridge, wherein said developing cartridge is equipped with:

a developing roller that supplies developer to the photosensitive drum cartridge, a feed roller that supplies developer to the developing roller, a first protrusion element that engages said developing cartridge into a mounting position on said photosensitive drum cartridge, a second protrusion element that inhibits rotation of said developing cartridge about said first protrusion element by engaging a developing cartridge engagement of an image forming apparatus when said developing unit is in a process unit mounting position in said image forming apparatus, and a third protrusion element for inhibiting rotation of said photosensitive drum cartridge relative to said image forming apparatus when said process unit is in said process unit mounting position, and wherein said first through third protrusion elements are located on an exterior of two walls of said developing cartridge that support both ends of said developing roller rotatably in said developing cartridge, wherein said photosensitive drum cartridge is equipped with:

a photosensitive drum, a fourth protrusion element located on an exterior of two walls of said photosensitive drum cartridge that support both ends of said photosensitive drum rotatably in said photosensitive drum cartridge, wherein said fourth protrusion element locks said photosensitive drum cartridge relative to the image forming apparatus when said process unit is in said process unit mounting position, and a rotation inhibiting component that inhibits rotation of said photosensitive drum cartridge about said fourth protrusion element in relation to the image forming apparatus by engaging with the third protrusion element of said developing cartridge, and wherein the developing cartridge is attachable to and detachable from the photosensitive drum cartridge.

8. A process unit according to claim 7, wherein said second protrusion element is located on the developing cartridge in an opposite direction from a mounting direction of said developing cartridge relative to said photosensitive drum cartridge.

9. A process unit according to claim 7, wherein said rotation inhibiting component is connected to a biasing means, and wherein said third protrusion element is configured such that said third protrusion element is pressed down by a biasing force of said biasing means via said rotation inhibiting element in a direction where said third protrusion element presses said developing roller into contact with said photosensitive drum.

10. A process unit according to claim 7, wherein said second protrusion element protrudes to a position that is even farther from a center of said developing cartridge than said third protrusion element.

11. A process unit according to claim 7, wherein said second protrusion element and said third protrusion element extend in parallel directions.

12. A process unit according to claim 7, wherein said first protrusion element is established on a rotation axis of said developing roller.

13. A developing cartridge, comprising:

a developing roller that supplies developer to a photosensitive drum where an electrostatic latent image is formed;

a feed roller that supplies developer to said developing roller;

a chassis that both supports said developing roller rotatably and can be attached to and removed from a photosensitive drum cartridge;

a first protrusion element that locks said chassis into a mounting position at said photosensitive drum cartridge;

a second protrusion element that inhibits rotation of said chassis about said first protrusion element by engaging a developing cartridge engagement of the image forming apparatus; and a third protrusion element that inhibits rotation of a cartridge for said photosensitive drum in relation to the image forming apparatus by engaging a rotation inhibiting element of said cartridge for said photosensitive drum, wherein said first through third protrusion elements are located on an exterior of two walls of said chassis that rotatably support both ends of said developing roller.

14. A developing cartridge according to claim 13, wherein said second protrusion element is located on the developing cartridge in an opposite direction from a mounting direction of said developing cartridge on the cartridge for said photosensitive drum.

15. A developing cartridge according to claim 13, wherein said third protrusion element is configured such that said third protrusion element is pressed down by a biasing force of a biasing means provided with the rotation inhibiting element, the biasing force pressing said third protrusion element in a direction where said third protrusion element presses said developing roller into contact with said photosensitive drum.

16. A developing cartridge according to claim 13, wherein said second protrusion element protrudes to a position that is even farther from a center of said developing cartridge than said third protrusion element.

17. A developing cartridge according to claim 13, wherein said second protrusion element and said third protrusion element extend in parallel directions.

18. A developing cartridge according to claim 13, wherein said first protrusion element is established on a rotation axis of said developing roller.

19. A developing cartridge configured to be combined with a photosensitive drum cartridge, the photosensitive drum cartridge including a first alignment member, the photosensitive drum cartridge and developing cartridge combination being insertable into an image forming apparatus, said image forming apparatus having inside surfaces including at least one surface that aligns said first alignment member, said developing cartridge comprising:

a toner supply; and a second alignment member including a first positioning component extending from a first side of the developing cartridge and a second positioning component extending from a second side of the developing cartridge located opposite the first side, wherein the first and second positioning components are aligned by direct contact with opposed inside surfaces of said image forming apparatus;

wherein said developing cartridge and said photosensitive drum cartridge are secured together prior to insertion into said image forming apparatus.

20. The developing cartridge according to claim 19, said developing cartridge further including a securing mechanism that engages said photosensitive drum cartridge.

21. The developing cartridge according to claim 19, said developing cartridge being secured by a securing mechanism located on said photosensitive drum cartridge.

22. The developing cartridge according to claim 19, wherein said first and second positioning components are cylindrical or columnar protrusions.

23. A developing cartridge configured to be combined with a photosensitive drum cartridge, the photosensitive drum cartridge including a first alignment member, the photosensitive drum cartridge and developing cartridge combination being insertable into an image forming apparatus, said image forming apparatus having inside surfaces including at least one surface that aligns said first alignment member, said developing cartridge comprising:

a toner supply; and a second alignment member including a first positioning component extending from a first side of the developing cartridge and a second positioning component extending from a second side of the developing cartridge located opposite the first side, wherein the first and second positioning components are aligned by direct contact with opposed inside surfaces of said image forming apparatus;

wherein said developing cartridge is required to properly align said photosensitive drum cartridge in said image forming apparatus.

24. The developing cartridge according to claim 23, wherein said developing cartridge and said photosensitive drum cartridge are combined prior to insertion into said image forming apparatus.

25. The developing cartridge according to claim 23, wherein said first and second positioning components are cylindrical or columnar protrusions.

* * * * *